US005487709A

United States Patent [19]

Froelich, Sr. et al.

[11] Patent Number: 5,487,709

[45] Date of Patent: Jan. 30, 1996

[54] ADJUSTABLE ROTATING RESISTANCE EXERCISER

[75] Inventors: Thomas E. Froelich, Sr., 2332 12th St., Cuyahoga Falls, Ohio 44223; Jeffrey T. Bertka, Cuyahoga Falls, Ohio

[73] Assignee: Thomas E. Froelich, Sr., Cuyahoga Falls, Ohio

[21] Appl. No.: 249,958

[22] Filed: May 27, 1994

[51] Int. Cl.[6] ..... A63B 23/14

[52] U.S. Cl. ..... 482/46; 482/49; 482/118; 482/80

[58] Field of Search ..... 482/44, 45, 46, 482/49, 79, 80, 114, 115, 118, 128

[56] References Cited

U.S. PATENT DOCUMENTS

| | | | |
|---|---|---|---|
| 2,668,055 | 2/1954 | Sharp et al. | 482/46 |
| 4,625,963 | 12/1986 | Lancellotti | 482/44 |
| 5,158,519 | 10/1992 | Hughes | 482/118 |

*Primary Examiner*—Richard J. Apley

*Assistant Examiner*—Lynne A. Reichard

*Attorney, Agent, or Firm*—Renner, Kenner, Greive, Bobak, Taylor & Weber

[57] ABSTRACT

An adjustable rotating resistance exerciser wherein an adjustment knob functions to supply an axial force to a series of interleaved washers and compressible washers to adjust the rotational restriction of a tubular grip handle, which is disposed on an inner collar that is affixed to a tubular handlebar. The exerciser may be configured such that it is adaptable to a riding bicycle or a stationary exercise bicycle or the exerciser may be affixed to various size robes or bars such that it may be used in any convenient location. A further embodiment of the present invention may be utilized by incorporating the adjustable rotating resistance exerciser with a tabletop unit which can be used by individuals confined to wheelchairs, hospital beds or nursing homes. Furthermore, the tabletop unit may be modified to accept foot plates so that individuals may use the rotational exerciser to exercise ankle and calf muscles. Additionally, the tabletop unit is configured such that it is lightweight, portable and may be easily disassembled for convenient storage.

10 Claims, 3 Drawing Sheets

ADJUSTABLE ROTATING RESISTANCE EXERCISER

TECHNICAL HELP

The invention herein resides generally in the art of adjustable resistance exercise equipment. More particularly, the invention relates to a table top exercise unit with adjustable rotating resistive handle grips. Specifically, the invention relates to a table top exercise unit with adjustable resistive rotating grips adaptable to variations which include utilizing a hand brake in conjunction therewith, a bicep/tricep exerciser in conjunction therewith, and a foot pedal attached thereto.

BACKGROUND ART

In the last fifty years, the general populace has increasingly recognized the need and importance of physical fitness. This need has arisen because of studies done by the medical community showing the importance of a balanced diet and moderate exercise. However, due to the increasingly sedentary lifestyle of the population, numerous home exercise devices have been developed. These devices include, but are not limited to, stationary bicycles, free weights and resistance weight machines that use specially designed rubber bands or pneumatic tubes.

In particular, various devices and exercisers have been developed to strengthen the hand, wrist, and forearm muscles. For example, dumbbells or free weights have been used to perform a wrist curl type exercise. A wrist curl is performed by holding a dumbbell in the palm of the hand with the fingers and thumb holding the weight therein. The dumbbell is first held with the palm of the hand towards the bicep muscle, the hand is then slowly relaxed letting the dumbbell roll down the fingers until the weight is supported by just the tips of the fingers. The weight is then slowly pulled back toward the bicep muscle by reclenching the fingers toward the palm of the hand. Another exercise device is the hand held wrist spring. This mechanism is used by placing the thumb on one of the ends of the spring and the tips of the fingers on the other and then drawing the thumb and the fingers together. Specialized rubber band type devices may also be used, whereby a person will hold each end of the rubber band in a receptive hand and then proceed to stretch and relax the rubber band in numerous repetitions. As muscles in the forearms develop, a higher resistance rubber band may be used to increase one's strength. It is also well known that squeezing a tennis ball or other similar type rubber ball will strengthen the hand and forearm muscles.

Unfortunately, use of the aforementioned exercise devices has several drawbacks. One problem is that once a person has exercised long enough with the aforementioned weight, spring, or rubber band device, that device will no longer be used as an increased resistance or heavier weight is required to further develop the subject muscle area. Another disadvantage is that these devices are not readily compatible with other exercise equipment nor are they portable.

While the use of the exercise devices to strengthen muscles is well known, it is also know that the flexing or stretching of muscles prior to activities requiring those muscles can lead to the most effective use of the muscles and prevention of injury thereto. Specifically, it has been found that persons using keyboards, sewing machines, or other devices requiring prolonged usage of the hands and arms in a rotated position are given to development of carpal tunnel syndrome. However, the risk of developing such a malady is significantly reduced when the arm and wrist muscles are flexed and exercised prior to the damaging activity. However, there is no known exercise device available for exercising the arm and wrist for such purpose.

Therefore, there is a need for a low impact resistance type exercise device adaptable with other exercise equipment that is easily adjustable to exercise the hand, wrist, and forearm muscles in addition to the muscles of the upper arm and upper back. There is also a need in the art for an exercise device adaptable to exercise the ankle and foot muscles. There is a further need for a simple and effective device as aforesaid which permits flexure of the wrist and forearm prior to engagement in keyboard-type activities. Furthermore, there is a need to provide such an exercise device that is adaptable in all its variations for use with coin operative mechanisms.

DISCLOSURE OF INVENTION

In light of the foregoing, it is a first aspect of the present invention to provide an adjustable resistance rotational exercise device.

Another aspect of the invention is to provide an adjustable resistance rotational exercise device that may be affixed to different types of tubes or bars of other exercise devices or stationary fixtures.

Still a further aspect of the present invention is to provide an adjustable resistance rotational exercise device that may be used on a riding bicycle or a stationary exercise bicycle.

An additional aspect of the present invention is to provide an adjustable resistance rotational exercise device that may be used on a tabletop base so that the device may be used on recreational vehicles or boats and is readily accessible, even by those confined to wheelchairs or hospital beds, or may be placed on the floor and modified to exercise the foot and ankle muscles.

Yet an additional aspect of the invention is to provide an adjustable resistance rotational exercise device with a bar to exercise the bicep and tricep muscles, the bar having a flexible knuckle therein with its own individual resistance levels or by attaching directly to the bar flexible robber bands or pneumatic tubes.

The foregoing and other aspects of the invention which shall become apparent as the detailed description proceed are achieved by an adjustable resistance rotational mechanism, comprising: means for resistance received within a tubular grip handle; and means for adjusting said means for resistance rotatably mounted to said tubular grip handle.

The present invention also provides an inner collar slidably mounted on a handlebar; an internally threaded square shaft extending axially from said inner collar; a tubular grip handle disposed over said inner collar and around said square shaft, there being disposed a plurality of compressible washers keyed to said square shaft and interleaved with a plurality of freely rotating washers keyed to said tubular grip handle; a knob washer disposed on said square shaft and abutting said grip handle; and, an adjustment knob having an adjustment screw mounted thereto, said adjustment screw received by said internally threaded square shaft so that said adjustment knob may be selectively rotated to apply an axially compressive force through said knob washers and said grip handle to said plurality of interleaved washers so as to control the rotatability of said tubular grip handle.

Furthermore, the invention may be modified so as to be mountable upon other exercise equipment such as a bicycle or by mounting upon a table top unit. The table top unit may also be modified to exercise the forearm, bicep, tricep, upper arm, shoulder and upper back muscles or to exercise the foot, ankle and shin and calf muscles.

BEST MODE FOR CARRYING OUT THE INVENTION

Figures 1, 2, 3, 4, 5:
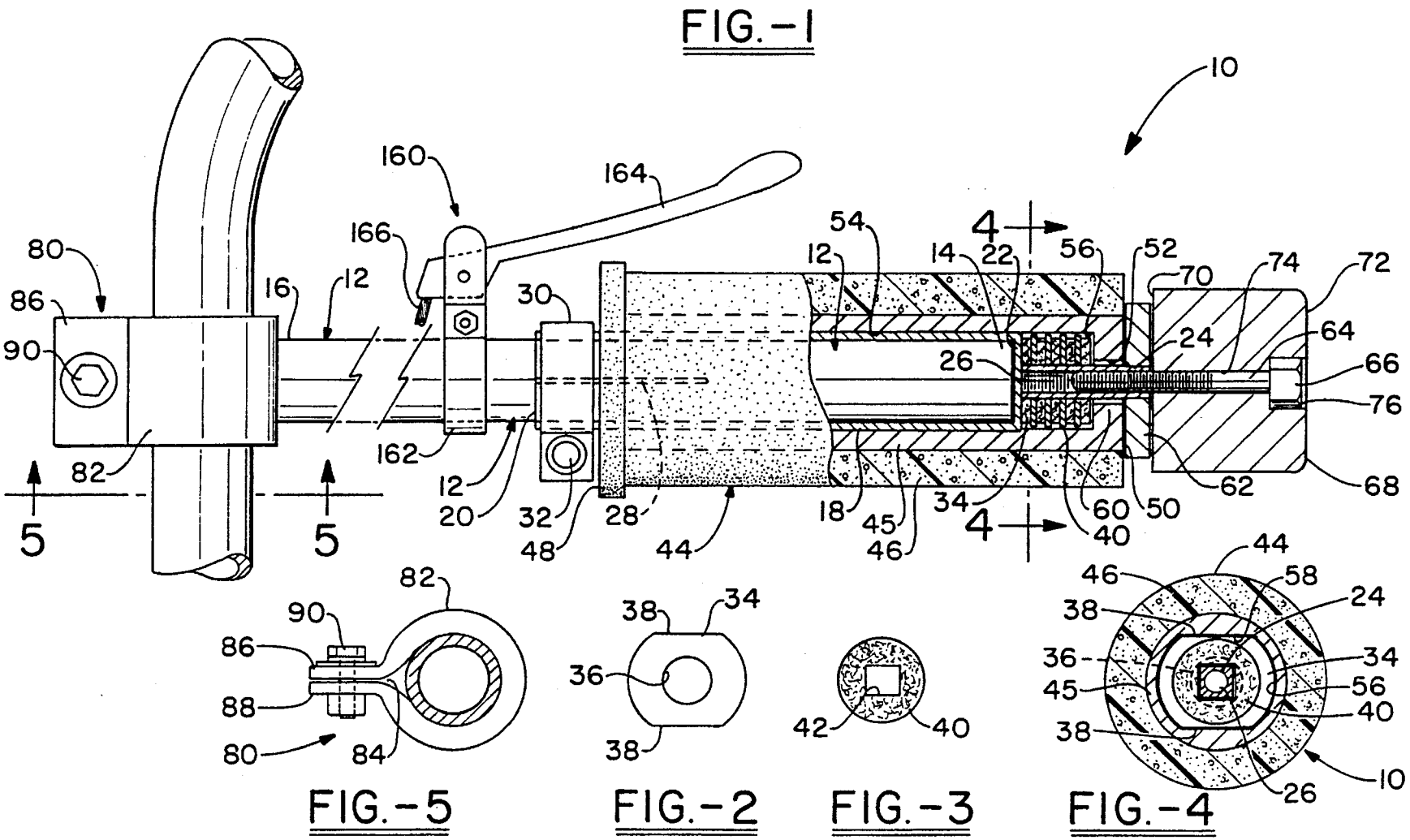
FIG. 1 is a partial sectional view showing an adjustable rotating resistance exerciser mechanism on a handlebar with an optional hand brake device located in close proximity therewith and a variable clamp device at the opposite end of the handlebar.
FIG. 2 is a plan view of a double D washer utilized to adjust the rotational resistance value of the present invention.
FIG. 3 is a plan view of a compressible washer utilized to adjust the rotational resistance valve of the present invention.
FIG. 4 is an end view, in cross-section as taken along line 4—4 of FIG. 1, showing double D washers and compressible washers in a working interrelationship with an internally threaded square shaft, which is affixed to the handlebar.
FIG. 5 is a cross-sectional view taken along the line 5—5 of FIG. 1 showing how a handlebar of the present invention is (or may be) clamped to an unrelated device.

Referring now to the drawings and more particularly to FIG. 1, it can be seen that an adjustable rotating resistance exerciser according to the invention is designated generally by the numeral 10. The exerciser 10 includes a handlebar 12 which, in the preferred embodiment, is a hollow metal robe with an adjustment end 14 opposite a fixed end 16. Disposed around the adjustment end 14 is an inner collar 18, which has an open end 20 opposite a closed end 22. As can be seen in FIG. 1, the closed end 22 of the inner collar 18 covers the adjustment end 14 of the handlebar 12. A square shaft 24, integral with the closed end 22, extends outwardly therefrom and is concentrically aligned therewith, and has disposed therein internal threads 26. The open end 20 of the inner collar 18 has at least two clamping cuts 28 lengthwise therewith which are diametrically opposed to each other. Disposed around the open end 20 of the inner collar 18 is a clamp 30. A clamp screw 32 is used to close the clamp 30 onto the inner collar 18, thereby compressing the inner collar at the area of the clamp cuts 28, so as to securely fasten the inner collar to the handlebar 12.

FIG. 2 shows a double D washer 34 which has a washer hole 36 centrally therein, the diameter of the hole 36 being large enough to freely rotate about the square shaft 24. In other words, the diameter of the hole 36 exceeds the length of a diagonal line interconnecting opposed comers of the square shaft 24. The double D washer 34 also has at least two flat portions 38 on the perimeter thereof and which are parallel to each other.

FIG. 3 shows a compression washer 40 which has a square hole 42 centrally therein. The square hole 42 is large enough to be disposed upon the square shaft 24, without being freely rotatable thereon. Furthermore, it will be appreciated hereinafter that the outer diameter of the compressible washer 40 is less than the distance between the parallel flat portions 38, of the double D washer 34.

Referring again to FIG. 1, those skilled in the art will appreciate that the double D washers 34 and the compression washers 40 are alternatingly interleaved on the square shaft 24. In the preferred embodiment, it should be appreciated that the double D washers 34 are made out of metal, and that the compression washers 40 are of a compressible fibrous material such as garlock.

A tubular grip handle 44 is disposed over the inner collar 18 and the plurality of interleaved double D washers 34 and compression washers 40. Preferably, the grip 44 has a rigid inner surface 45, either metal or plastic and a foam outer surface 46. The tubular grip handle 44 further includes an open end 48 adjacent the clamp 30, opposite a knob end 50 that surrounds the interleaved washers 34 and 40. The knob end 50 has a shaft hole 52 which is disposed over the square shaft 24 and is concentrically aligned therewith. The inner surface 45 has an interior portion 54 which slidingly bears upon the inner collar 18. At the knob end 50, and integral with the interior portion 54, is an interior portion 56 surrounding the washers 34, 40. As can be seen in FIG. 4, the interior portion 56 has a diameter slightly larger than the major diameter of the double D washer 34. It should also be appreciated that the diameter of the interior portion 56 is larger than the diameter of the compressible washer 40. Within the interior portion 56 are at least two parallel flat sections 58 which interrupt the otherwise cylindrical surface of the portion 56. The flat sections 58 correspond to, but are separated by a distance slightly greater than the distance between the parallel double D washer flats 38. Thus, as the tubular grip handle 44 is rotated, the flat sections 58 engage the flats 38 and force the double D washers 34 to rotate in a similar manner about the square shaft 24. In other words, the washers 34 are effectively keyed to and are rotatable with the grip 44.

Referring again to FIG. 1, a handle lip 60 at the knob end 50 serves to hold the interleaved double D washers 38 and compressible washers 40 on the square shaft 24. A knob washer 62 is fittingly disposed on the square shaft and abuts the knob end 50 of the tubular grip handle 44. An adjustment screw 64, which has a screw head 66, fastenably secures an adjustment knob 68 to the square shaft 24. The adjustment knob 68 has a washer side 70, which abuts the knob washer 62, and an opposite outer side 72. The adjustment knob 68 has a screw hole 74 which supports the adjustment screw 64, there being integral therewith a bore 76 for securely holding the screw head 66. The screw head 66 is press-fit into the bore hole 76 such that as the adjustment knob 68 is turned the adjustment screw 64 is rotated in a similar fashion.

With continued reference to FIG. 1, the operational features of the adjustable rotating resistance exerciser 10 will now be explained. An individual desiring to use the exerciser 10 will place a hand upon the foam outer surface 46 of the tubular grip handle 44 and reciprocatingly rotate the handle to exercise the foream muscles, wrist, and the muscles within the hand. If the individual determines that the exerciser 10 is too loose or rotates too freely, he or she may then rotate the adjustment knob 68 in a clockwise direction. As the adjustment knob 68 is rotated, the adjustment screw 64, which is integral with the adjustment knob 68 at the bore 76, functions to pull the adjustment knob into the internal threads 26 of the square shaft 24. This results in the adjustment knob 68 applying an axial force to the knob washer 62, which correspondingly transmits an axial force to the handle lip 60, which transmits an axial force to the plurality of interleaved double D washers 34 and compression washers 40. Therefore, as those skilled in the art will appreciate, as the tubular grip handle 44 is rotated the flat section 58 will correspondingly engage and rotate the double D washers 34. As a result, since the square holes 42 of the compression washers 40 key the washers to the square shaft 24, the compression washers 40 are prevented from rotation about the square shaft 24, thus the axial force applied by the adjustment knob 68 serves to create a frictional force between the interleaved compressible washers 40 and the rotating double D washers 34. Accordingly, by rotating the adjustment knob 68, varying levels of rotational resistance can be set for the exerciser 10. It should further be appreciated that the knob washer 62, which is rotatable about the square shaft 24, prevents the rotation of the grip handle 44 from changing the resistance level set by the adjustment knob 68. Those skilled in the art will appreciate that the alternatingly interleaved washers 34, 40, in combination with the adjustment knob 68, serve as an adjustment brake providing the resistive force for the exerciser 10.

As seen in FIG. 1 and further illustrated in FIG. 5, an adapter damp 80, which is integral with the handlebar 12, is utilized to affix the adjustable rotating resistance exerciser 10 to various size tubes and bars. The adapter damp 80 has a clamp hoop 82 that is integral with the handle bar 12. A hoop split 84 divides the clamp hoop 82 into a head protrusion 86 which is opposite a thread protrusion 88. A clamp screw 90 interconnects the head protrusion 86 to the thread protrusion 88, thereby providing for adjustment of the tightness of the clamp hoop 82 onto the desired robe or bar. Those skilled in the art will appreciate that the adjustable rotating resistance exerciser 10 can be easily adapted for use with a tiding bicycle, stationary exercise bicycle, or on any number of exercise devices.

Figure 7:
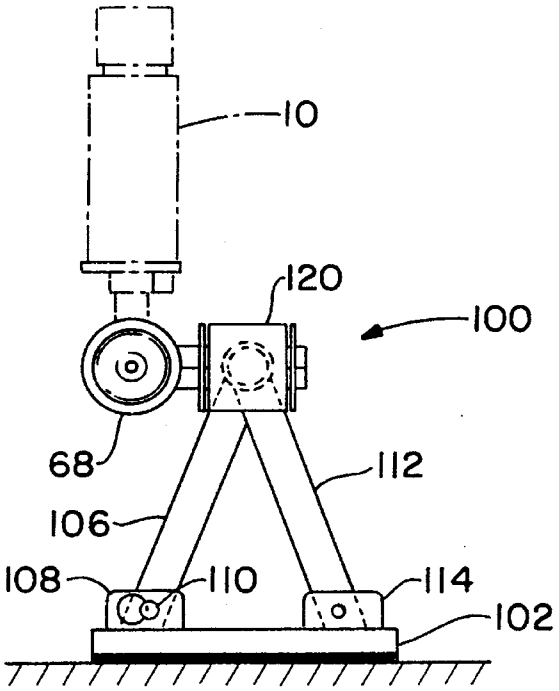
FIG. 7 is a side elevational view of the tabletop exercise unit shown in FIG. 6.
Figure 6:
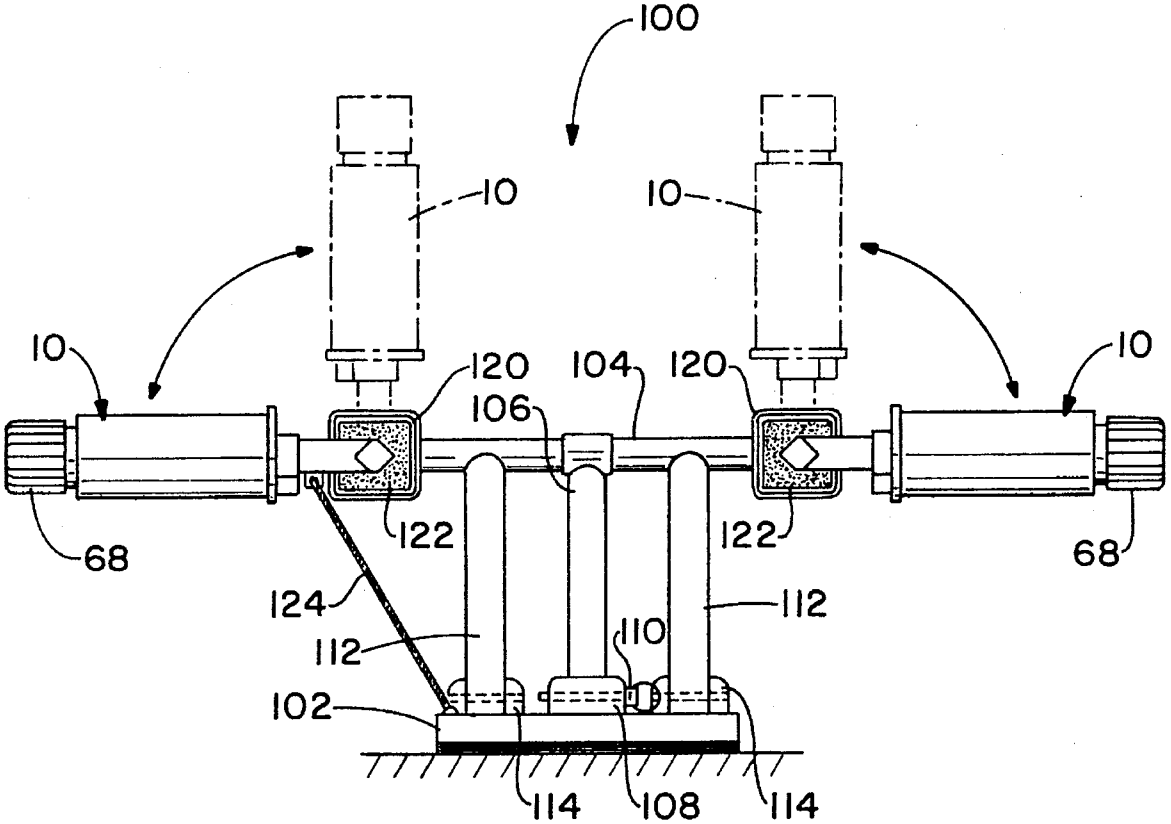
FIG. 6 is a front elevational view of a tabletop exercise unit utilizing an adjustable resistance rotational mechanism of the present invention.

Referring now to FIG. 6, the exerciser 10 may be used in conjunction with a tabletop unit 100, which has a non-skid base 102 from which upwardly extends a center leg 106. The center leg 106 is integral with or rotatably mounted to a handlebar 104 which has disposed on each end an adjustable rotating resistance exerciser 10. A detachable coupler 108 is integral with the base 102, so as to pivotally connect the center leg 106 therein. A removable pin 110 is used to interconnect the center leg 106 to the detachable coupler 108. At least two pivot legs 112 extend downwardly from the handlebar 104 to pivot mounts 114, so as to rotatably affix the pivot legs 112 to the base 102. Typically, the pivot mounts 114 will be in a position offset from the detachable coupler 108 as shown in FIG. 7.

In a further embodiment illustrated in FIG. 6, a knuckle system 120 is incorporated into the handlebar 104. The knuckle system 120 allows the rotating resistance exerciser 10 to be pivotally extended upward to a perpendicular position with respect to the handlebar 104, thereby allowing exercising of the bicep, tricep, upper arm, shoulder and back muscles. The knuckle system 120 also allows the simultaneous use of the rotation exerciser 10, thereby providing an exercise device that works all the muscles of the wrist, hand and arm. Various size rubber inserts 122 having a range of resistive values are provided for placement within the knuckle 120 to allow a person to adjust the device depending upon their strength. The resistive values of the inserts 122 will typically be characterized by the durometer of the rubber from which the inserts are made. A further variation of this embodiment provides that flexible rubber bands 124 or other suitable types of resistance may be affixed between the base 102 and the handlebar 104 to provide the desired resistance levels.

Figure 9:
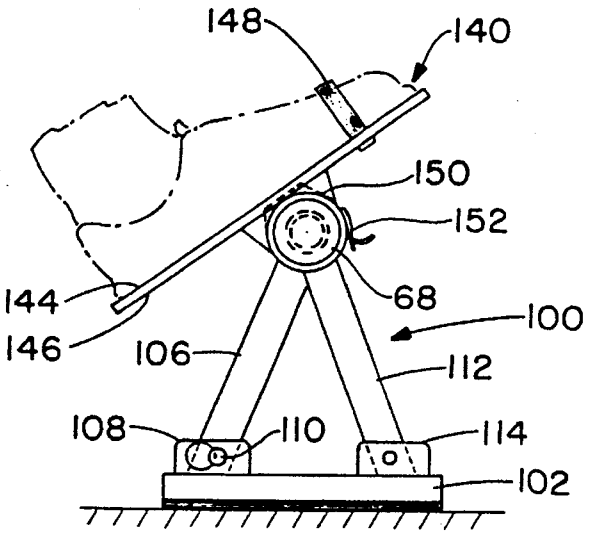
FIG. 9 is a side elevational view of the tabletop exercise unit shown in FIG. 8.
Figure 8:
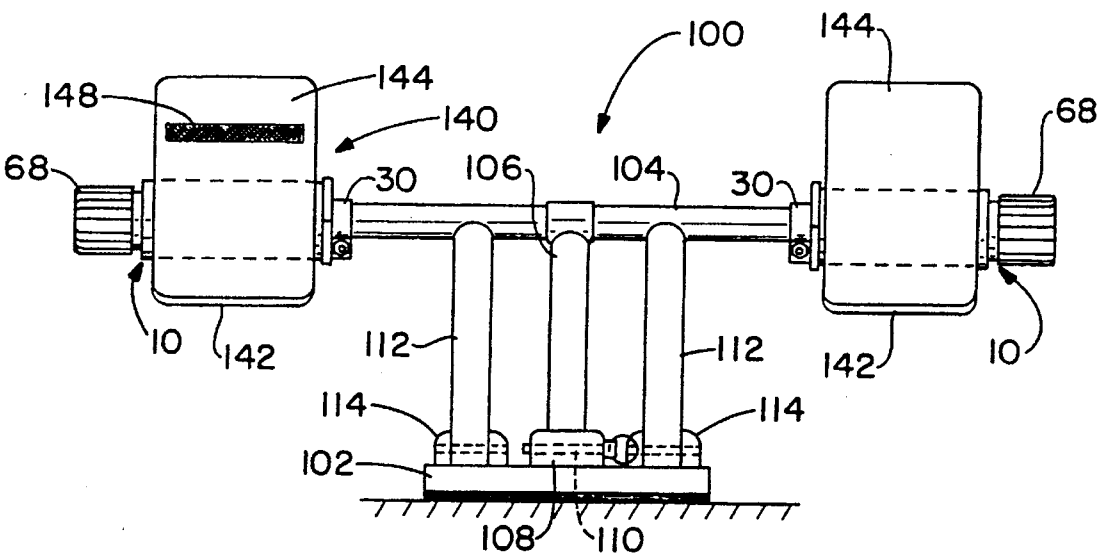
FIG. 8 is a front elevational view of the tabletop exercise unit with foot pedals attached to the adjustable resistance rotational mechanism.

Referring now to FIG. 8, it can be seen that the tabletop unit 100 can also be modified to create a foot pedal exerciser 140. The foot pedal exerciser 140 includes a foot plate 142, which has a foot side 144 opposite a grip side 146. A toe restraint 148 is incorporated into the foot side 144 so that an individual may hold his or her foot on the foot plate 142 while performing the exercise. As seen in FIG. 9, handle side 146 has mounted thereto a foot clamp 150 which has a clamp latch 152 that is mounted upon the tubular grip handle 44 of the adjustable rotating resistance exerciser 10. Here, the user can exercise his calf and ankle in much the same fashion as he would his wrist and forearm.

Referring back to FIG. 1, it can be seen that the exerciser 10 may be used upon the actual handle bars of a bicycle. In such a case, a hand brake 160 would typically be located in close proximity to the exerciser 10. The hand brake 160 includes a mount 162 which is affixed to the handlebar 12. Extending upwardly and outwardly from the mount 162 is a hand lever 164 which, in standard fashion, in interconnected by a cable 166 to a caliper. Therefore, as a person utilizes his bicycle, the rotational exerciser 10 may also be simultaneously used.

As can be seen in FIG. 1 and FIG. 5, the resistance exerciser 10 may be mounted upon various size tubes or bars for easy interchange by the person utilizing the equipment. Another use of the exerciser 10 is with a table top unit as illustrated in FIGS. 6 and 7. The tabletop unit 100 allows the exercisers 10 to be used by individuals who are confined to wheelchairs, hospital beds or nursing homes. As part of a physical therapy program, the physical therapist may set the resistance levels of the exerciser 10 to achieve a certain fitness goal. It should also be appreciated that the foam handle 46 allows an individual to squeeze the handle while simultaneously rotating the handle, thereby further exercising muscles within the hand.

It should also be appreciated that the tabletop unit 100 can be disassembled or folded down for easy storage. By removing the pin 110, the center leg 106 may be removed from the detachable coupler 108. The legs 106, 112 may then be straightened or folded onto each other while handlebar 104 pivots downwardly about the pivot mount 114 to lie upon the base 102. In such a flat posture, the tabletop unit 100 can be stored within a cabinet or underneath a bed.

Thus it can be seen that the objects of the invention have been satisfied by the structure presented above. It should be apparent to those skilled in the art that the objects of the present invention could be practiced by any person of varying physical ability.

While various embodiments of the invention have been presented and described in detail, it will be understood that the invention is not limited thereto or thereby. Especially in that various materials may be used in the construction of the invention to meet the various needs of the end-user. Accordingly, for an appreciation of the true scope and breadth of the invention, reference should be made to the following claims.

What is claimed is:

1. An adjustable rotating resistance exerciser, comprising:

a handlebar;

an inner collar disposed around and mounted to at least one end of said handlebar;

an internally threaded square shaft extending axially from said inner collar;

means for generating resistance disposed on said internally threaded square shaft;

a tubular grip handle disposed over said means for generating resistance and said inner collar such that said tubular grip handle rotates around said handlebar; and means for adjusting said means for generating resistance, wherein said means for adjusting is rotatably mounted to said tubular grip handle.

2. An adjustable rotating resistance exerciser according to claim 1, wherein said means for generating resistance comprises a plurality of compressible washers keyed to said square shaft and interleaved with a plurality of freely rotating washers keyed to said tubular grip handle.

3. An adjustable rotating resistance exerciser according to claim 2, wherein said means for adjusting selectively applies an axial force to said plurality of interleaved washers to control the rotatability of said tubular grip handle.

4. An adjustable rotating resistance exerciser according to claim 3, wherein said means for adjusting comprises:

an adjustment knob having an adjustment screw mounted thereto, said adjustment screw received by said internally threaded square shaft; and a knob washer interposed between said adjustment knob and said tubular grip handle for transferring an axial force therebetween.

5. An adjustable rotating resistance exerciser according to claim 4, wherein a clamp is disposed around and mounted to said handlebar opposite said adjustment knob, said clamp adaptable to receive various types of fixtures.

6. An adjustable rotating resistance exerciser, comprising:

a handlebar;

an inner collar disposed around and mounted to at least one end of said handlebar;

an internally threaded square shaft extending axially from said inner collar;

a tubular grip handle disposed over said inner collar and around said internally threaded square shaft, wherein said internally threaded square shaft has disposed thereon a plurality of compressible washers keyed to said internally threaded square shaft and interleaved with a plurality of freely rotating washers keyed to said tubular grip handle such that said tubular grip handle rotates around said handlebar;

a knob washer disposed on said internally threaded square shaft and abutting said grip handle; and an adjustment knob having an adjustment screw mounted thereto, said adjustment screw received by said internally threaded square shaft so that said adjustment knob may be selectively rotated to apply an axially compressive force through said knob washers and said tubular grip handle to said plurality of interleaved washers so as to control the rotatability of said tubular grip handle.

7. An adjustable rotating resistance exerciser according to claim 6, wherein a damp is disposed around and mounted to said handlebar opposite said adjustment knob, said clamp being adaptable to receive various types of fixtures.

8. In combination, at least one adjustable rotating resistance exerciser, and a table top unit for use in conjunction with the adjustable rotating resistance exerciser, comprising:

an adjustable rotating resistance exerciser, having an inner collar disposed around at least one end of a handlebar, an internally threaded square shaft extending axially from said inner collar, means for generating resistance disposed on said internally threaded square shaft, a tubular grip handle disposed around said means for generating resistance and said inner collar such that said tubular grip handle rotates around said handlebar, and means for adjusting said means for generating resistance, wherein said means for adjusting is rotatably mounted to said tubular grip handle; and a table top unit having a base with a detachable coupler, a plurality of pivot mounts disposed thereon, a center leg pivotally mounted to said detachable coupler by a pin at one end and rotatably mounted to said handlebar at an opposite end, and a plurality of pivot legs integrally mounted to said handlebar at one end and pivotally mounted to said pivot mounts at an opposite end.

9. The combination according to claim 8, wherein said handlebar has resistive means incorporated therein between said pivot legs and said adjustable rotating resistance exerciser, said resistive means allowing said handlebar to be pivotally extended upward while rotating said adjustable rotating resistance exerciser.

10. The combination according to claim 8, wherein at least one tubular grip handle has a foot pedal exerciser mounted thereto.

* * * * *